US007740720B2

(12) United States Patent
Fogel

(10) Patent No.: US 7,740,720 B2
(45) Date of Patent: Jun. 22, 2010

(54) PLATINUM-PALLADIUM ALLOY

(76) Inventor: Kenneth D. Fogel, 159 Myrtle Ave., Millburn, NJ (US) 07041

( * ) Notice: Subject to any disclaimer, the term of this patent is extended or adjusted under 35 U.S.C. 154(b) by 0 days.

(21) Appl. No.: 12/077,225

(22) Filed: Mar. 18, 2008

(65) Prior Publication Data

US 2008/0232999 A1 Sep. 25, 2008

Related U.S. Application Data

(63) Continuation-in-part of application No. 11/221,308, filed on Sep. 7, 2005.

(51) Int. Cl.
*C22C 5/04* (2006.01)

(52) U.S. Cl. ..... 148/430; 420/465; 420/466

(58) Field of Classification Search ..... 148/430, 148/678; 420/463–468
See application file for complete search history.

(56) References Cited

U.S. PATENT DOCUMENTS 1,498,073 A * 6/1924 Cohn ..... 436/84
1,545,234 A * 7/1925 Cohn ..... 420/466
2,279,763 A * 4/1942 Sivil ..... 420/465
2005/0284257 A1* 12/2005 Osada et al. ..... 75/228
2008/0063556 A1* 3/2008 Battaini ..... 420/464
2008/0168799 A1* 7/2008 Fogel ..... 63/15

OTHER PUBLICATIONS

H. Renner, Platinum group metals and compounds, in Ullmann's Encyclopedia of Industry Chemistry, Jun. 15, 2001, p. 1, 39-47.*
T. Biggs et al. The hardening of platinum alloys for potential jewelry application, Platinum Metals Review, 2005, vol. 49, Issue 1, p. 2-15.*
ASM Handbook, vol. 2, Properties and Selection: Nonferrous Alloys and Special-Purpose Materials, "Platinum-Palladium Alloys", 10th edition, 1990, p. 1-18 (18 total).*

* cited by examiner

*Primary Examiner*—George Wyszomierski
*Assistant Examiner*—Mark L Shevin
(74) *Attorney, Agent, or Firm*—Fox Rothchild LLP; Peter J. Butch, III; Roman Fayerberg

(57) ABSTRACT

An alloy for use in jewelry applications is provided that has a composition comprising about 45 to about 55 platinum by weight and about 55 to about 45 percent palladium by weight. The alloy possesses favorable characteristics as compared to pure platinum and pure palladium. Due to these characteristics, the alloy is attractive for use in jewelry applications.

9 Claims, 3 Drawing Sheets

PLATINUM-PALLADIUM ALLOY

CROSS-REFERENCE TO RELATED APPLICATIONS

This application is a continuation in part of U.S. application Ser. No. 11/221,308, filed on Sep. 7, 2005, and incorporated herein by reference in its entirety.

FIELD OF THE INVENTION

This invention relates to an improved platinum-palladium alloy and more particularly a platinum-palladium alloy with particular utility for use in jewelry applications.

BACKGROUND OF THE INVENTION

In the jewelry trade the main competitor to platinum, in terms of advantageous physical and chemical properties, is white gold. Gold is not only the name of a precious metal; it is also its color. In addition, in order to comply with Quality Mark Standards and Trade Descriptions Acts in various parts of the world, there are strict limits on what may be described as standard platinum. The British Hallmarking Act, for instance, defines hallmarkable platinum as an alloy or mixture with a composition of not less than 95% of the element platinum, with no negative tolerance. In some countries, a small proportion of the 'platinum' may actually consist of platinum group metals. Thus, "standard platinum" can vary in its properties, which properties are normally a function of the composition of pure platinum, including color. Of course, in jewelry applications, a subjective property, such as color, can be important in a commercial context.

Recently there has been increased interest in defining what qualifies as white gold and a code of practice is under international discussion. Several white metals may bleach the 'yellow' color from gold but the resulting alloy must also meet Quality Mark Standards. It is generally impractical to make an acceptable white gold above 18 carat, while it is easier at 14 carat and easier still at 9 carat. Eighteen carat white gold is probably the strongest competitor to platinum and so the comparative color of white gold is of considerable interest. Some of the 18 carat white golds have at least a slight yellow tinge. The code of practice relies on a color analyzer under standardized conditions and calibrated against a standard white tile surface to determine the spectrum of white color light components. For white gold, they are then converted to a 'yellowness index;' a high value being evidently yellow, and a low, or near-zero, value being neutral white. The values obtained also depend on the reflectance of the surface which, in turn, depends on texture.

Another important factor in the utility of white gold is the hardness value. The harder the material, the easier it is to polish and the better the polish holds with wear. However, one skilled in the art would realize that often a harder material will prove more difficult to work. Hard materials tend to be brittle and will break or shatter when bent or flexed. Therefore, a platinum alloy having a high tensile strength, while maintaining a reasonable working level of ductility would be highly desirable. Ductility is reported as the percent elongation to break. Typically, for a material to be able to fold in half (double back on itself) repeatedly, a percent elongation to break of 50% or greater is needed.

Currently, there is still a need in the art for a platinum alloy that can compete with white gold.

SUMMARY

In one aspect an alloy is provided that has a composition comprising about 45 to 55 platinum by weight and about 55 to about 45 percent palladium by weight. In some embodiments, the composition comprises at least 50 percent platinum by weight. In other embodiments, the composition comprises about 50 to about 55 percent platinum by weight and about 45 to about 50 percent palladium by weight, or about 50 to about 50.5 percent platinum by weight and about 49.5 to about 50 percent palladium by weight. Alternatively, the composition may consist essentially of about 50.5 percent platinum by weight and about 49.5 percent palladium by weight.

In another aspect, an alloy is provided having a composition comprising about 45 to about 55 platinum by weight, about 55 to about 45 percent palladium by weight, and between about 0.25 and about 0.5 percent of iridium by weight. In another embodiment, in addition to platinum and palladium, the alloy may include up to about 1 percent by weight of iridium and ruthenium, and more preferably about 0.5 percent by weight of iridium and 0.5 percent by weight ruthenium.

The present alloys may have a penetration hardness ranging from about 66 Hv at 0% reduction to about 166 Hv at about 85% reduction. They may also have a yellowness index between about 10 and 12, or of 11.9. In some embodiments, the tensile strength of the present alloy is about 13.5 tsi.

In yet another aspect, articles of jewelry made from various alloys described above are provided. Methods of making article of jewelry from the alloys described above are also provided.

DETAILED DESCRIPTION OF INVENTION

Figure 1:
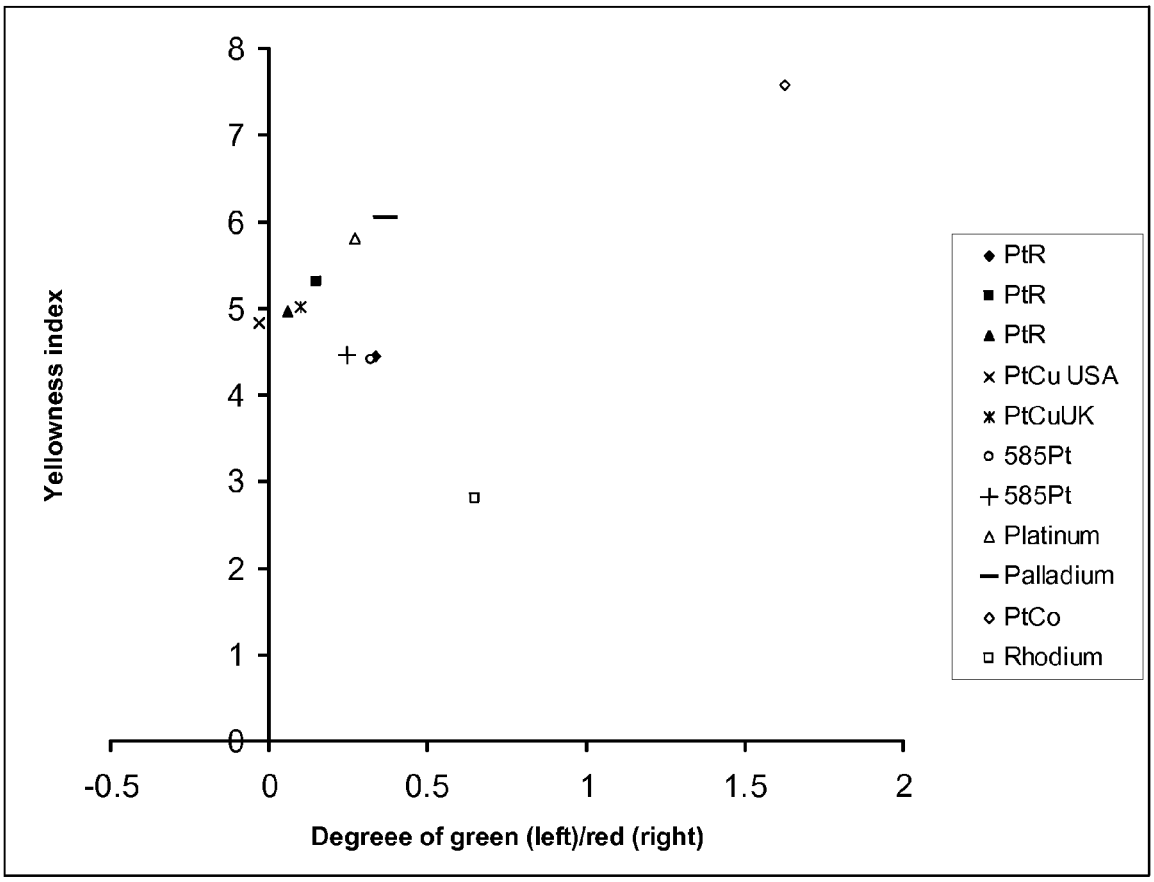
FIG. 1 presents data of ASTM yellowness test for various alloys.

The alloy of this invention comprises about 45 to about 55 percent by weight platinum and about 55 to about 45 percent by weight palladium which provides a synergy, affording a stronger, whiter material than either of its two components. In some embodiments, the alloy includes about 50 to about 55 percent by weight platinum and about 45 to about 50 percent by weight palladium. In other embodiments, the alloy may comprise about 50 to about 50.5 percent by weight platinum and about 49.5 to about 50 percent by weight palladium. In yet other embodiments, the ratio of platinum to palladium may be about 50.5 to about 49.5 percent by weight, respectively.

Generally, it is desirable that the platinum makes up at least 50% of the alloy. Accordingly, in some specific embodiments, the finished casting may comprise 50.5% platinum, 50.2% platinum, or 50.1% platinum, and the rest being palladium or metal additives. The term "about" refers to variations in the numerical quantities that can occur, for example, through typical measuring and testing procedures, through inadvertent error in these procedures, through differences in the manufacture, source, or sensitivity of measuring and testing equipment; and the like.

The alloy of this invention may also include metal additives selected from both platinum group metals ("PGM") and non-platinum group metals. Preferably, the metal additives may replace palladium. The other platinum group metals include rhodium, ruthenium, osmium, and iridium. In certain embodiments, the alloy may include between about 0.25 and about 0.5 percent by weight of iridium which is known to refine the grain structure. Alternatively, the alloy may include iridium and ruthenium. Preferably, the combined ratio of the iridium and ruthenium in the alloy may be 1 percent by weight, and more preferably the alloy may comprise about 0.5% of each of iridium and ruthenium. In yet other embodiments, the present alloy may include ruthenium. Adding ruthenium may produce greater hardness as-cast and greater work-hardenability, but it is preferable to limit the amount of ruthenium to around 5% in order to enable homogenization. Other metal additives may include, but are not limited to, zirconium, tin, niobium, indium, nickel, zinc, silicon, boron, tungsten, molybdenum and mixtures thereof.

The inventors unexpectedly discovered that the alloy of the present invention possesses characteristics that could not be predicted by averaging corresponding characteristics of platinum and palladium individually. Accepted metallurgical principles dictate that the physical properties of a binary alloy are generally the weighted mean of the composition of the component metals. However, the mechanical and optical properties of the present alloy unexpectedly do not follow this tendency. More specifically, tests have shown that the ultimate tensile strength and elongation in annealed condition are significantly higher in the alloy of the present invention than would be predicted from the values for the individual components, weighted for composition. In addition, for the alloy of the present invention, the elastic limit strength, which is used a as failure criterion for jewelry applications, is raised more per percent reduction than is the elastic limit strength of pure palladium or pure platinum. In one embodiment, ultimate tensile strength of the alloy was measured at 13.5 tons per square inch (tsi), whereas the tensile strength of pure platinum and pure palladium was 9 tsi and 10 tsi respectively. Since elongation at 20° C. was measured at 26% for an as-cast specimen of the present alloy, the elongation of the annealed specimen is expected to be in excess of the value of 40% which was measured for each annealed platinum and annealed palladium specimen.

In addition, the work hardening range of the alloy of the present invention is greater than for pure platinum and palladium, and its work hardening rate is higher than either of the metals alone. The present alloy work hardens steadily over an unusually extensive working range making it possible to design sequences that will give a good balance of workability and final (surface and internal) hardness for relatively simple ring sections. Polishing ability, an important characteristic for jewelry applications, is related to surface hardness and may be raised by shallow hardening. Although it is generally known that adding palladium to platinum increases its hardness, currently the highest ratio of palladium in the available platinum-palladium alloys is 15%. As also important for jewelry uses, in addition to being harder than pure platinum and pure palladium, the alloy of the invention is whiter than both, a necessary subjective characteristic for any jewelry material, making it a commercially acceptable alternative for white gold.

The color of the present alloy was measured by a color analyzer under standardized conditions and calibrated against a standard white tile surface to determine the spectrum of white color light components. Measurements are typically obtained using standard color measurements which are calibrated for surface conditions which in turn depend on texture. For white golds, such data is converted to a "yellowness index." The lower the yellow index value, the whiter the material. In one embodiment the present alloy has an ASTM yellowness index between 10 and 12. In comparison, the yellowness index for pure platinum is 13.4. In another embodiment, the yellowness index of the present alloy is 11.9 or 12.

Figure 2:
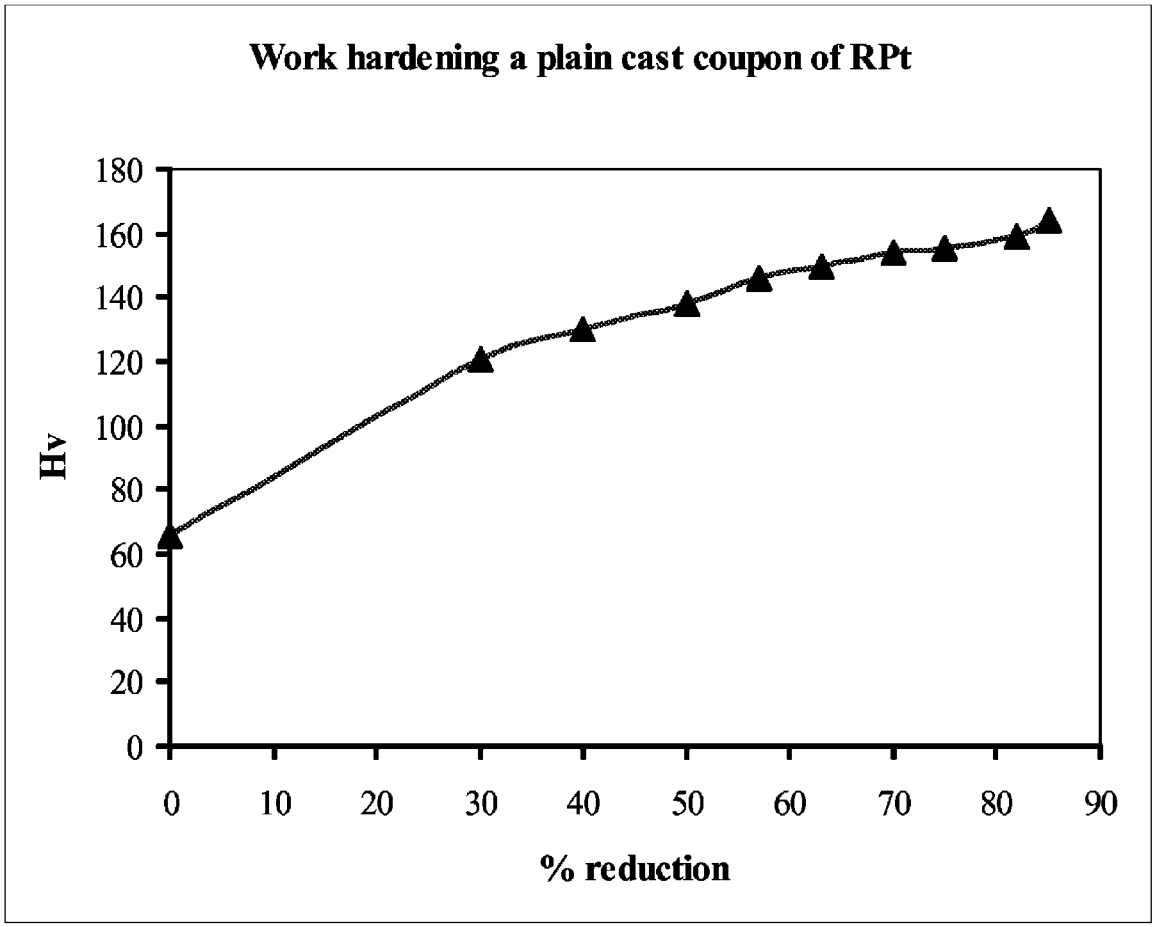
FIG. 2 presents hardness test results for a cold-worked coupon made from the present alloy.
Figure 3:
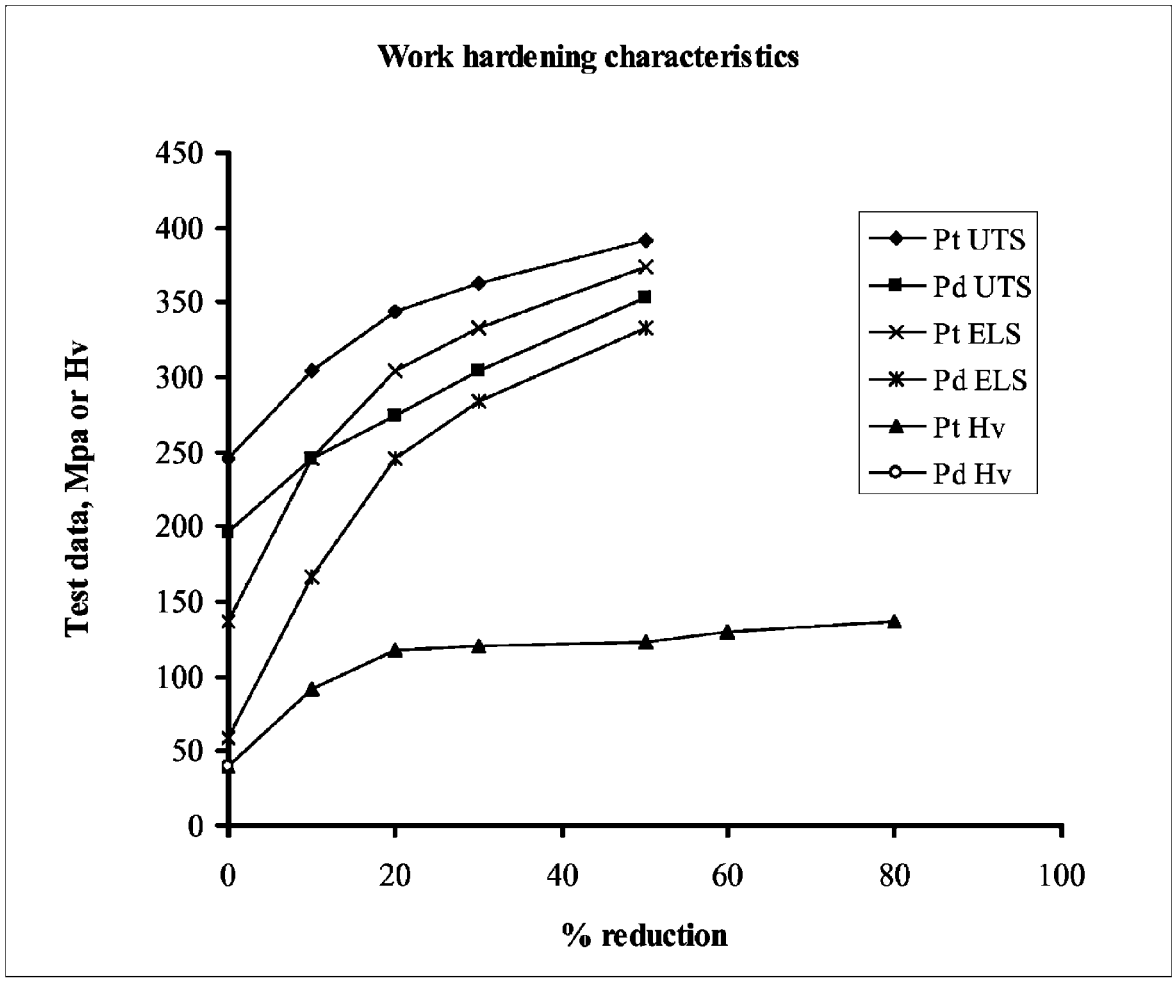
FIG. 3 presents tensile strength, elasticity strength and hardness test data for pure platinum and palladium alloys.

As indicated above, the present alloy work hardens over an extensive range. One way to test work-hardenability is to cast a coupon of the alloy, make a hardness test on the casting, cold work the casting to reduce its cross-section by increasing amounts, and make further hardness tests after every reduction. As shown in FIG. 2, in one embodiment, the hardness for the present alloy ranges between about 66 Hv as cast, i.e., 0% reduction, to 166 Hv at about 85% reduction. In other embodiments, the hardness of the cold worked taper rod made of the present alloy ranges between about 147 Hv to 151 Hv, or between about 146 Hv to about 166 Hv, depending on the reduction in cross-section as a result of cold work. In yet other embodiments, the hardness of the cold worked parallel rod made of the present alloy ranges between about 131 to 138 Hv or between about 154 Hv to about 156 Hv depending on the reduction in cross-section as a result of cold work. In contrast, as shown in FIG. 3, hardness of pure platinum and pure palladium at is 49 Hv at 0% reduction. The hardness of pure platinum goes up to about 140 Hv at 80% reduction.

Without wishing to be bound by any theory, the inventor postulates that these discrepancies in hardness may be due to shrinkage cavities in samples as cast. The percentage rolling reduction is calculated from the change in cross-section assuming that the whole cross-section is solid (cast) metal. If there are shrinkage cavities, the rolls do not need to exert the full amount of work to achieve the new dimensions and the calculation over-estimates the work done, but a lower hardness results. Similarly, the highest hardness achieved (in this case, 166 Hv) may be an under-estimate of the highest hardness possible attainable due to potential shrinkage cavities in test samples.

The hardness range for the alloy of the present invention starts higher than for pure platinum and pure palladium, and its work hardening rate is also higher than both. Representative hardness values for annealed palladium can be as low as 37 Hv and for pure platinum about 55 Hv. In one embodiment, the hardness of the alloy of the present invention as cast is about 65 Hv. These values provide a fair comparison of the hardness of different materials since, typically, as-cast hardness is similar to the annealed hardness.

The high elastic limit strength and good workability coupled with the exceptional whiteness of this alloy makes it particularly suitable for use in jewelry applications. Rings and other fine jewelry pieces need high hardness and elastic strength in order to maintain their surface finish over extended wearing. One skilled in the art would recognize that all possible jewelry articles that can be made of this alloy include, but are not limited to, rings, earrings, bracelets, watches, pendants, and necklaces.

Jewelry may be made from the alloy of the present invention using any known metal shaping processes. Examples of suitable metal shaping processes include casting, forging, flow forming, rolling, extrusion, sintering, metalworking, machining, electroplating, and fabrication. With the exception of electroforming and powder metallurgy, most production routes begin with either a cast component or a cast 'ingot' that is subsequently worked into sheet, strip, wire, section, or forged to shape. Preferably, investment casting is utilized to make jewelry from the present alloy.

The alloys of this invention may be prone to shrinkage cavities. These can occur in heavy sections, particularly along the centerline of the thickest sections, unless the investment technology is precisely controlled. Rough surface finish often accompanies centerline shrinkage as though the melt has reacted with the inner surface of the investment. Poor investment and casting practice for heavy sections causes extensive dilation when casting all PGM alloys (and to a lesser extent, palladium white golds). Dilation is a slight ballooning of the mold cavity caused by too much heat and mechanical energy when the molten alloy reaches the mold cavity so that it reacts with and pushes back the investment. This causes a greater than intended demand for feeder alloy to top up the natural solidification shrinkage (normally about 5%). The gates to the casting cavities freeze and the already inadequate feeder alloy supply stops prematurely. The resulting castings are unsound and larger than the original wax pattern.

One suitable test for casting soundness is to compare the precise dimensions of a selected section of the wax with the corresponding dimensions of the section cast from the wax. In theory, the casting should be smaller than the wax by a small amount due to thermal contraction on cooling to room temperature. Although, in practice, other factors may hide this, it may be assumed that any significant increase in dimension is due to unfed shrinkage for the present purpose of the test. This also implies that the density of the casting is less than it should be and, thus, accurate weighing in and out of water (Archimedes displacement method) can be a useful measure of shrinkage volume/dilation.

Casting practices for the present alloy follow, in most respects, those for all standard platinum alloys such as use of high temperature melting and casting units, high-grade crucibles (avoiding graphite), and acceptable (non-gypsum bonded) investment materials and processes. The first step in the casting process involves making patterns of the products to be cast from wax, plastic or foam. Several of these patterns may be placed on the runner bar to form what is known as pattern trees which are dipped into investment. Dipping the pattern tree into investment forms a ceramic shell around the patterns which will be used as a casting mold in subsequent steps.

Since the present alloy is typically cast at high temperatures, special platinum style investments are preferably employed. Using platinum style investments made from acid bonded fine graded silica refractory instead of gypsum bonded investment prevents molten alloy from reacting with the interior surface of the mold and prevents mold dilation. As described above, the dilation may cause shrinkage cavities in casting. Dilation may also be prevented or, at least minimized, by reducing the casting energy necessary for the melt to fill the mold cavity and begin directional solidification progressively back to the central feeder sprue.

Suitable platinum style investments include, but are not limited to, Astrovest and ALL89. They may be shipped as a two-part or as a single part investment. The single part investments may be preferred, as in two-part investments the binder has to be mixed correctly first, then added in the correct ratio to the powder. Although it simplifies shipping and investment life, it also introduces a further variable in a process that requires careful control. Typically, the manufacturers recommend concentrations that are usually about 5% of binder concentrate to 95% water. While it may be beneficial to use a stronger mixture, i.e. a mixture with more binder added to powder and less water added to the mixture, for closely spaced heavy sections, it is very unlikely to be ideal for all alloys and sections. A person with ordinary skill in the art is capable of adjusting the concentrations of binder concentrate to water based on the type of alloy and sections' characteristics. It is advisable to have a specific standard procedure for each casting alloy and differentiate at least between the heaviest and lightest sections in the same alloy. It is normally preferable not to mix patterns from different weight categories on the same tree.

Since the investment powders and bonding acids are typically hygroscopic, it is advisable to store them in a controlled environment. Preferably, the powders are stored for at least 10 hours at 18° C. in an air-conditioned space together with the mixing vessels (they can quickly rise to 30° C. near casting machines). Air conditioning and/or a dehumidifier ensures that investment powders do not absorb significant amounts of moisture. If kept in high humidity conditions, the investments may be over-diluted as most suppliers recommend water to powder ratio on dry weight but investment powders can absorb considerable amounts of moisture from the atmosphere without showing early signs of dampness. This may weaken the investment.

It is possible to shorten the mixing and working times of gypsum-bonded and acid-bonded investments by increasing the temperature of the mixture. The bonding chemical reaction causes heat and it is preferable that powder and water temperature are both below about 20° C. at the start, and more preferable below about 18° C. The difference between a warm humid day and a cool dry day can have a marked effect on mixing, pouring mobility and time to gloss-off. If the reaction time is unintentionally short, the flasks poured last may already be experiencing the stiffening of the investment fluid before complete filling. In this state, the now setting investment is very fragile and very easily damaged. Since the flasks are fragile for a period of time even under normal investment conditions, they are preferably not moved at all or moved very carefully. In addition, hydrofluoric acid (HF) may be used for cleaning the casting later in the process but its fumes may act as a catalyst in moisture absorption and may speed up the mixing and setting reactions. Accordingly, the fumes of HF in the investment atmosphere are preferably minimized. Alternative investments mixtures may be employed if the investments are weak even when used as described above.

In the next step, the wax, foam, or plastic patterns are removed from the investment shell by, for example, allowing them to melt and drip from the shell. It may be achieved by using a high pressure steam, exposing the investment shells to high temperatures up to about 200 C, or any other techniques known and used in the art. Next, the investments shells are fired at a temperature of about 800-900 C into a refractory mold, and are filled with the molten alloy to cast the product. Alternatively, the wax or foam may be left in place to be vaporized by the alloy when it is poured into the mold. The heat of the alloy vaporizes the wax or foam a short distance away from the surface of the alloy, leaving the molding cavity into which the metal flows. Various methods of pouring the molten metal include vacuum casting, anti-gravity casting, tilt casting, gravity pouring, pressure assisted pouring, centrifugal casting.

When weighing out the platinum and palladium for melting, the starting ratios of platinum to palladium should correspond to their target ratio in the final alloys as described above. A charge may be prepared from new material, scrap material, or a combination thereof. In the preferred embodiment, the charge may consist of 50% new material and 50% scrap. It is advantageous to precut all of the charge, both scrap returns and new metal, into small pieces (roughly coarse rice to pea size) or bridging can easily occur which increases the total melting time. Preferably, the pieces are small enough so the entire charge fits into the crucible within the induction coil field. The flask can be in place before melting begins and the whole casting operation may be completed under vacuum in a very short time, less than 50 seconds.

In addition to new material and casting scrap, swarf from metalworking operations may also be used as melting stock for castings. Swarf will normally mix with roughly an equal weight of coarser fresh material or casting scrap to ensure more even melting and less risk of bridging. It has exactly the same value as bought in melting stock. In some embodiments, it may be possible to make new castings from a 100% scrap charge. If swarf is used, this assumes close proximity and technical control of both machining and re-melting, careful segregation of swarf and thorough cleaning to take care of potential contamination. There are transport, security and contamination risks in subcontracting the machining and the swarf may be of lower value, particularly if it is to return to the refiner.

The solidus/liquidus temperatures for the present alloy are 1620/1662° C. Fluidity is desired and, thus, the preferable temperature range for pouring is between about 1700° C. and about 1750° C., depending on the weight and design of the cast product selected for each pattern tree, among others. Generally, the temperature may need to be set higher when a lot of thin sections have to be fully filled, whereas lower temperatures may be sufficient for heavier sections. For example, a superheat of 50° C. should be sufficient for heavy rings, small slabs, and billets, whereas a superheat of up to 100° C. may be used for small settings. At these high temperatures, good temperature calibration and measurement during melting are highly beneficial to ensure extended crucible life, control of any slag reactions, and accurate and appropriate pouring temperatures for various sections.

Excessive heat during the casting step may lead to mold dilation which is, as described above, the primary cause for centerline shrinkage defects. Accordingly, it is desirable to maintain the casting temperature as low as possible. Accurate temperature calibration and control ensures appropriate casting temperature. Also, minimum casting energy is preferably utilized. In addition, the furnace sight glass may be easily scarred from drops of molten alloy which may cause the pyrometer to read a lower than real temperature at the surface of the melt. Since it may lead to overheating the charge and too high casting temperature, it is desirable to change the glass when the scarring is first noticed.

Next, the investment shell is removed from the casting by any technique known and used in the art. This is generally done with water jets, vibration, grit blasting or chemical dissolution. Platinum style investments are typically more difficult to remove from castings than are gypsum-bonded investments. Removal may be aided by minimizing the 'burn-on' bond between the hot cast surface and reaction with the investment surface. One way to eliminate or minimize the "burn-on" bond is to cast at lower casting temperatures or velocities.

In addition, quenching the whole flask while the casting is still red-hot may also simplify the investment shell removal. With the present alloy, there is no need to wait while the whole flask cools below 500° C. Quenching from a higher temperature aids investment breakdown which reduces the effort in subsequent pressure washing and preserving in HF. Fragile sections in all jewelry alloys may be a little cooler than the rest of the piece and may contract faster than the remaining investment. This can cause cracking due to a combination of thermal shock and inability to contract freely. Although except for temperatures in the liquidus/solidus gap, the present alloy is fully ductile and very unlikely to show signs of such hot shortness, it may be advisable to check the fragile sections of the casting for signs of cracking.

After quenching, the casting with residual investment may be pushed out or tapped out of the mold. Almost all of the remaining investment may be removed by power washing using plain water. If casting conditions are good, the surface of the casting will be smooth and only traces of investment will still adhere in less obvious angles and pockets.

The final cleaning stage, knowing as pickling, may use an acid such as, for example, a hydrofluoric acid. One technique is to use initially concentrated hydrofluoric acid at room temperature working overnight in a closed compartment with absolute minimum human intervention. In one embodiment, a 20% concentration hydrofluoric acid is used initially at a temperature of around 60-70° C. for around one hour in a closed compartment with controlled air circulation and a neutralizing filter on the exhaust. The concentration of the acid falls until it takes perhaps up to 3 hours to achieve the required degree of cleaning. The spent acid may be discharged into spent gypsum investment where it will be neutralized. After the investments shells are removed, the clean castings may be immersed in an alkaline solution to neutralize any remaining acid traces, particularly in sprue shrinkage cavities, and rinsed in plain water and dried.

It is desirable to clean the sprue system as well as the wanted castings. The sprue scrap may be re-melted with fresh metal, as described above. In addition, any remaining investment and acid may form a slag or react with the crucible. In either case, melt temperatures may be difficult to control, crucible life will be shorter and slag may easily enter the next batch of castings.

The cooled castings may be removed from the tree by, for example, sawing or clipping. Some castings may need grinding of the gate and runner bar attachments. The castings may be in the form of the final product or as a starting stock such as tubes, thick sheet, small slabs or hollow tube billets. If the castings are made as a starting stock, they may be hot forged, cold worked, laser welded, or machined to turn the material into the final product. A person with the ordinary skill in the art would undoubtedly be familiar with such techniques and would be capable of selecting the appropriate technique based on physical characteristics of the starting material and the final product.

The alloy as-cast does not finish as hard and, for some applications, may be improved by retaining a degree of cold work. Any technique known and used in the art may be employed depending on the desired degree of retained work hardening and the shape and form of the casting. Suitable methods include, but are not limited to, burnishing, coining, stamping, rolling, deep or cold drawing, die pressing, or the combination of methods.

If a product is exposed to excessive heat after cold working, most of the cold work hardness can be lost. Accordingly, the work-anneal sequence is preferably carefully planned so that the final dimensions are attained while retaining cold work. Annealing time and temperature may be selected depending on the amount of cold work done on the product or the characteristic of the alloy. In one embodiment, it may require no more than 1 hour at 800° C. In other embodiments, the material with fine grain may be annealed at 750° C. for 40 minutes. If, afterwards, there has to be extensive heat treatment or flame soldering or flame welding, most of the residual cold work hardness is lost. Laser welding is a valuable technique for retaining cold work hardness because in the present alloy, the thermal diffusivity is low and the intense laser heat stays close to the target spot. The present alloy work hardens steadily over an unusually extensive working range and it is possible to design sequences that will give a good balance of workability and final (surface) hardness for relatively simple ring sections.

EXPERIMENTAL

EXAMPLE 1

Color Analysis of Platinum

First, a typical sample of the present alloy was compared with pure platinum based on ASTM Yellowness (YI) index D:1925 test (Method 46) developed and described by Henderson and Manchanda in 2005. This test magnifies the differences in transition from yellow gold to white gold, and is reflected in convention for naming white golds as follows: good white is less than 19.0; reasonable white is about 19.0 to 24.0, off-white is about 24.5 to 32.0, and non-white is greater than 32. The results of this test are presented in Table 1 below:

TABLE 1

Color data comparison.

| Sample | ASTM YI Index |
|---|---|
| Present alloy | 11.9 |
| 100% Pt | 13.4 |
| 100% Pd | 12.01 |

Next, the present alloy was compared with various other relevant alloys of pure rhodium, platinum and palladium without recalculating the results to yield a yellowness index. The results are presented in FIG. 1. As can be seen from this data, the present alloy is unexpectedly whiter than either pure platinum or pure palladium.

EXAMPLE 2

Work-Hardenability

One way to judge work-hardenability is to cast a coupon of the alloy, make a hardness test on the casting, cold roll by increasing amounts and make further hardness tests after every reduction. FIG. 2 shows typical results of rolling and cross-rolling a 20×20×4 mm coupon of the present alloy.

EXAMPLE 3

Hardness of Platinum Alloys

Table 2 below compares the penetration hardness results for the present alloy with other platinum alloys and pure palladium.

FIG. 3 presents additional data for typical tensile strength, elasticity strength and hardness test results for pure platinum and palladium.

TABLE 2

Typical hardness results for the present alloy compared with other PGM alloys.

| Alloy | Description | Cast (Hv) | Cold worked (HV) @ (% reduction) |
|---|---|---|---|
| RPt | Sheet | 65 | 147-160 Av 152 (about 50%) |
| Pt/4.5% Cu | Sheet | 106 annealed | 207-223 Av 214 (about 50%) |
| RPt | Taper rod A | 66 (0%) | 147 (49%), 151 (55%), 131 (60%), 151 (65%), 147 (70%). |
| | B | | 154 (32%), 166 (41%), 153 (48%), 153 (57%), 146 (63%). |
| RPt | Parallel rod A | 66 (0%) | 138, 132, 131.(approx 25% effective) |
| | B | | 153, 156, 154.(approx 35% effective) |
| 95% Palladium | Taper rod A | | 85 (30%), 110 (31.5%), 110(36%), 114(44%), 109 (47%), 100 (49%). |
| | B | | 76 (22%). 96 (36%), 95 (43%), 95 (46%), 120 (49%). |
| 95% Palladium | Parallel rod A | | 99, 80.2, 111. |
| | B | | 108. 107 |
| 14K white gold | Taper rod A | | 249 (26%), 260 (39%), 280 (57%). |
| | B | | 260 (33%), 277 (44%), 260 (56%). |
| 14K white gold | Parallel rod A | | 274, 289. |
| | B | | 240, 289. |

The present alloy worked extremely well but had centerline shrinkage. The highest hardness was 163-166 Hv after 41% cold rolling reduction but that reduction figure was unreliable due to internal shrinkage. The alloy is most likely capable of further work-hardening. The results for the present alloy samples do not show the expected work hardening curve because the as-cast shapes were not fully sound. The percentage rolling reduction is calculated from the change in cross-section assuming that the whole cross-section is solid (cast) metal. If there are shrinkage cavities, the rolls do not need to exert the full amount of work to achieve the new dimensions and the calculation over-estimates the work done but a lower hardness results. The highest hardness achieved (in this case 166 Hv even though the effective reduction is probably lower than calculated, 40%) is a likely under-estimate of the hardness achievable.

The argument for the 950-palladium results is very similar. There was shrinkage in the as-cast samples and so the work-hardening curve is unreliable. The highest hardness, 120 Hv, after about 50% cold reduction, is significantly less than that achieved for the present alloy under similar conditions.

EXAMPLE 4

Tensile Properties of the Present Alloy

The three pairs of rods rolled from parallel samples used in Example 3 were tensile tested on a Hounsfield Tensometer Model H20K-W. The results are presented in Table 3 below:

TABLE 3

Hardness and tensile test results on pairs of rods rolled from parallel castings in the three alloys.

| Alloy | Hv | intended % cw | estimated % cw | UTS tsi | Elong % |
|---|---|---|---|---|---|
| Royal | 134 | 57 | 25 | 23.0 | 10 |
| Platinum | 155 | 62 | 40 | 25.3 | 2 |
| 95% | 96.7 | 62 | 26 | 2.23 | 2 |
| Palladium | 108 | 67 | 34 | 28.5 | 4 |
| 14K white | 281.5 | 40 | 45 | 38.7 | 11 |
| gold | 265.5 | 70 | 35 | 57.0 | 6 |

Column 3 represents the intended rolling reductions assuming sound cast metal 4 mm square and Column 4 presents the effective reduction estimated from the hardness achieved. Both samples fractured prematurely (one very low residual elongation and both lower UTS than previous samples) through stress raisers that were originally coarse shrinkage. Both samples fractured prematurely (very low residual elongation) at stress raisers that were originally oxidized shrinkage. Features that were observed in the samples jagged fracture near machine grips include slight signs of centre line shrinkage, and premature fracture. In addition, normal brittle fracture near machine grips (and outside gauge length) was also observed. It may render the elongation uncertain but the uncertainty is not expected to be high.

To understand the results in Table 3, it is best to regard the testing of both parallel and tapered test pieces as both a test of casting soundness and of work-hardenability. The latter will only be maximized if the test piece is fully sound; otherwise, even the highest result will represent the minimum attainable. The fracture surfaces in four tensile tests more or less clearly showed premature failure through defects at the mid-thickness of the rods. The fracture surface of the 950 palladium alloy was badly discolored due to oxidation of cobalt. It is likely that palladium catalyzes the oxidation of cobalt (and possibly other elements). This suggests that vacuum or inert gas was not used during the melting of that alloy and the resulting cobalt oxide would prevent closure of the shrinkage by any amount of cold rolling.

EXAMPLE 5

Casting of Present Alloy

Two wax trees carried several designs varying from a 2-mm section earring hoop to several heavy shanks with diamond set shoulders where the top width was 8 mm, on the same tree. Another tree carried mostly light to medium sections. Typical waxes for the heavy sections were measured at the top and at finger diameter for later comparison with the as-cast dimensions of those already on the tree (where it is inconvenient to measure accurately). Normally, a melter would prefer to set the casting machine controls to ensure that the thin section would run. On the other hand, if the thin section does not run, the scrap caused would be less costly than one scrap heavy section and so settings more suited to the heavy sections should be used, i.e., lower casting temperature (1710° C.), less acceleration (T5) and lower rpm in spinning (360). The duration of spinning is relatively unimportant as long as it exceeds the likely time of solidification; 15 seconds almost always exceeds the time for which pressure can be exerted on the still liquid feed metal at the gate of the casting. The flask temperature already set for 750° C. was left unaltered. However, it was possible (later) to lower the flask temperature to decrease potential reaction between the investment and a heavy injection of molten alloy. The lighter section tree was cast at 1730° C. at acceleration T7 and spin at 480 rpm (settings higher and closer to the melter's normal choice).

The result was that all sections filled adequately, even the 2-mm section earring hoop. A few of the heaviest cast section surfaces did show minor water/tide marks and occasional patches of investment abrasion on otherwise smooth texture cast surface. These are almost certainly evidence that the ALL89 investment did not cope perfectly with even the less intensive casting energies. The corresponding sections were measured and compared with typical wax dimensions as in Table 4.

TABLE 4

Comparison of wax and as-cast dimensions in a production batch.

| Ring # | Wax Top width, mm | Cast Top width, mm | Wax finger diam, mm | Cast finger diam, mm |
|---|---|---|---|---|
| 1 | 7.98 | 7.98 | 19.86 | 19.76 |
| | 7.98 | 7.98 | 19.86 | |
| 2 | 7.98 | 8.00 | 19.86 | 19.63 |
| | 7.98 | 8.12 | 19.86 | |
| 3 | 8.00 | 7.99 | 19.86 | 19.80 |
| | 8.00 | 8.12 | 19.86 | |
| 4 | 8.10 | 8.01 | 19.86 | 19.96 |
| | 8.10 | 8.08 | 19.86 | |
| 5 | 8.08 | 8.00 | 19.86 | 19.94 |
| | 8.08 | 8.02 | 19.86 | |
| Averages | 8.03 | 8.03 | 19.86 | 19.76 |

There is excellent agreement between the average wax and the average as-cast dimensions. The average of the cast finger dimensions was 0.1 mm smaller than the single wax diameter but this is not conclusive; it is very difficult to measure a wax shank internal dimension without distorting the shank slightly. The lower casting energy settings appear to have prevented dilation in the heavy sections.

The cast taper pegs used for work hardenability testing (described earlier) are also useful for checking casting parameters. The cast pegs start nominally as hand carved waxes 4 mm square at one end, 2.5 mm square at the other, and 35 mm long. With expensive alloys, this is an economic test of both casting quality and work hardenability.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the following claims.

What is claimed is:

1. A cast article comprising a platinum-palladium alloy consisting essentially of platinum group metals and comprising from about 45 to about 55 percent platinum by weight, from about 45 to 55 by weight palladium, from about 0.25 to about 0.5 percent by weight iridium, and ruthenium optionally present in an amount to form a total content of ruthenium and iridium of 1 percent by weight or less.

2. The cast article of claim 1, wherein said article is annealed work hardened, or both.

3. The cast article of claim 1, wherein said alloy comprises at least about 50 percent platinum by weight.

4. The cast article of claim 3, wherein said alloy comprises about 50 to about 55 percent platinum by weight and about 45 to about 50 percent palladium by weight.

5. The cast article of claim 1, wherein said alloy comprises about 0.5 percent by weight iridium and about 0.5 percent by weight of ruthenium.

6. The cast article of claim 1, characterized in that said article is an article of jewelry.

7. The cast article of claim 6, wherein the article of jewelry is selected from the group consisting of rings, earrings, bracelets, watches, pendants, and necklaces.

8. The cast article of claim 1, wherein said alloy has a tensile strength of about 13.5 tsi.

9. The cast article of claim 2, wherein said alloy is work hardened to a penetration hardness between about 66 Hv and about 116 Hv.

* * * * *